US005788377A

United States Patent [19]

Vetter

[11] Patent Number: 5,788,377

[45] Date of Patent: Aug. 4, 1998

[54] TAMPER-RESISTANT ENVELOPE

[75] Inventor: Kurt W. Vetter, Huntington, N.Y.

[73] Assignee: Uniflex, Inc., Westbury, N.Y.

[21] Appl. No.: 773,166

[22] Filed: Dec. 26, 1996

Related U.S. Application Data

[63] Continuation of Ser. No. 471,534, Jun. 6, 1995, abandoned.

[51] Int. Cl.[6] ..... B65D 33/34

[52] U.S. Cl. ..... 383/5; 383/61; 383/93; 383/107

[58] Field of Search ..... 383/5, 61, 76, 383/78, 80, 93, 95, 107

[56] References Cited

U.S. PATENT DOCUMENTS

| | | | |
|---|---|---|---|
| 3,279,331 | 10/1966 | Platt . | |
| 4,276,982 | 7/1981 | Sibrava et al. . | |
| 4,358,015 | 11/1982 | Hirsch . | |
| 4,402,453 | 9/1983 | Regenstein, Jr. . | |
| 4,483,018 | 11/1984 | Whelan . | |
| 4,491,196 | 1/1985 | Edelman et al. . | |
| 4,712,729 | 12/1987 | Craig | 383/5 X |
| 4,834,552 | 5/1989 | Makowka . | |
| 4,874,090 | 10/1989 | Dyke . | |
| 4,937,040 | 6/1990 | Holcomb et al. . | |
| 5,041,072 | 8/1991 | McClelland . | |
| 5,049,118 | 9/1991 | McNabb . | |
| 5,082,702 | 1/1992 | Alband . | |
| 5,346,301 | 9/1994 | Scarberry et al. . | |
| 5,350,238 | 9/1994 | Bolton | 383/5 |
| 5,391,136 | 2/1995 | Makowka . | |
| 5,405,197 | 4/1995 | Makawka | 383/5 |

FOREIGN PATENT DOCUMENTS

| | | | |
|---|---|---|---|
| 459311 | 12/1991 | European Pat. Off. | 383/5 |
| 1025034 | 4/1966 | United Kingdom | 383/5 |
| 2145997 | 4/1985 | United Kingdom | 383/5 |
| 2193484 | 2/1988 | United Kingdom | 383/78 |
| 2265883 | 10/1993 | United Kingdom | 383/5 |
| 2278594 | 12/1994 | United Kingdom | 383/5 |

*Primary Examiner*—Jes F. Pascua
*Attorney, Agent, or Firm*—Dilworth & Barrese

[57] ABSTRACT

A tamper-resistant envelope is disclosed which includes first and second panels joined to one another to define opposed side edges and a bottom edge of the envelope. Each of the panels have an upper edge which together define an opening opposite the bottom edge of the envelope for providing access into the envelope. The upper edge of the second panel extends beyond the upper edge of the first panel to define a panel extension. A layer of adhesive sealant material is disposed on an interior surface of the first panel adjacent the upper edge thereof for sealingly adhering to an interior surface of the second panel. The sealant material has adherent properties which are resistant to release at temperatures substantially below room temperature. The envelope also includes an adhesive sealing strip having a lower portion mounted to an exterior surface of the first panel and an upper portion positioned to sealingly adhere to the panel extension of the second panel.

21 Claims, 4 Drawing Sheets

TAMPER-RESISTANT ENVELOPE

This is a continuation, of application Ser. No. 081471, 534 filed on Jun. 6, 1995 now abandoned.

BACKGROUND OF THE INVENTION

1. Field of the Invention

The subject invention is directed to plastic security envelopes, and more particularly, to a tamper-resistant envelope having two types of adhesive closure seals associated therewith.

2. Description of the Related Art

Plastic security envelopes are well known in the art. They are commonly utilized to transport money, checks, bonds, stocks, food stamps, medical specimens, jewelry and other items of value. These envelopes must be constructed to remain closed during transport and handling, and resist tampering such that the contents are not compromised.

One problem that has arisen with respect to the adhesive materials utilized to seal plastic security envelopes is that the seals may be covertly opened after closure by lowering the temperature of the sealed region. This can be accomplished by spraying the envelope with a freon-type material or applying dry ice to the envelope seal. Once opened, the contents of the envelope can be accessed or removed, and the envelope can be subsequently resealed without any evidence of tampering.

Adhesive materials having adherent properties which are resistant to low temperatures are also known and have been employed on security envelopes to prevent tampering. For example, U.S. Pat. No. 4,937,040 to Holcomb et al. discloses an adhesive closure system which includes means for forming indicia therein if the envelope is opened at temperatures substantially below room temperature. To fabricate the adhesive closure system, multiple layers of adhesive material are applied to the surfaces of the envelope. This fabrication process is time consuming and costly.

The subject invention provides an improved low-cost tamper resistant security envelope which employs two different types of adhesive seals including one which is unaffected by low temperatures.

SUMMARY OF THE INVENTION

The subject invention is directed to an improved tamper-resistant security envelope for transporting items of value. The envelope includes first and second panels which are joined to one another to define opposed side edges and a bottom edge of the envelope. Each of the panels has an upper edge and together they define an opening opposite the bottom edge of the envelope for providing access into the envelope. The upper edge of the second panel preferably extends beyond the upper edge of the first panel to define a panel extension.

The envelope has two adhesive seals associated therewith. The first adhesive seal is formed by a layer of adhesive sealant material which extends across an interior surface of one of the two panels adjacent the upper edge thereof for sealingly adhering to an interior surface of the other of the two panels. Preferably, the adhesive sealant material has adherent properties which are resistant to release at temperatures substantially below room temperature. Thus, the first seal inhibits the opening of the envelope by spraying freezing agents or applying dry ice to the seal region.

The second adhesive seal is defined by a prefabricated adhesive sealing strip or tape having a lower portion mounted to an exterior surface of the first panel and an upper portion positioned in such a manner so as to sealingly adhere to an interior surface of the panel extension of the second panel. Preferably, a release liner strip is associated with the seal region of the envelope and is coextensive with the layer of adhesive sealant material and the upper portion of the adhesive sealing strip to prevent their contact with the interior surfaces of the envelope prior to closing.

In a preferred embodiment of the security envelope of the subject invention, a removable flap is operatively connected to the second panel extension to define a receipt. A perforation line extends across the second panel extension to delimit the removable flap and facilitate the removal thereof. Preferably, numerical indicia is imprinted on the removable flap and corresponding numerical indicia is imprinted on one of the first and second panels to identify the envelope.

The envelope is preferably formed from a single piece of material which is folded in such a manner so as to define the first panel and the second panel. Once folded, the opposed side edges of the envelope are fused to one another. Alternatively, the first and second panels may be formed separate from one another and subsequently fused together along the opposed side edges thereof. Preferably, the opposed fuse lines which form the envelope extend from the bottom edge of the envelope and terminate at a location below the upper edge of the first panel. The first and second panels may also be further fused together at a plurality of linearly spaced apart locations adjacent the opposed fuse lines to define opposed skip seals which increase the tamper resistance of the envelope. In addition, geometric patterns are imprinted on the exterior surfaces of the first and second panels about the peripheries thereof. The patterns are adapted and configured to become distorted if envelope tampering occurs.

These and other features of the security envelope of the subject invention will become more readily apparent to those skilled in the art from the following detailed description of the preferred embodiments of the invention taken in conjunction with the drawings.

BRIEF DESCRIPTION OF THE DRAWINGS

So that one skilled in the art to which the subject invention appertains will better understand how to make and use the invention, preferred embodiments thereof will be described hereinbelow with reference to the drawings wherein.

DETAILED DESCRIPTION OF THE PREFERRED EMBODIMENTS

Figures 1, 2:
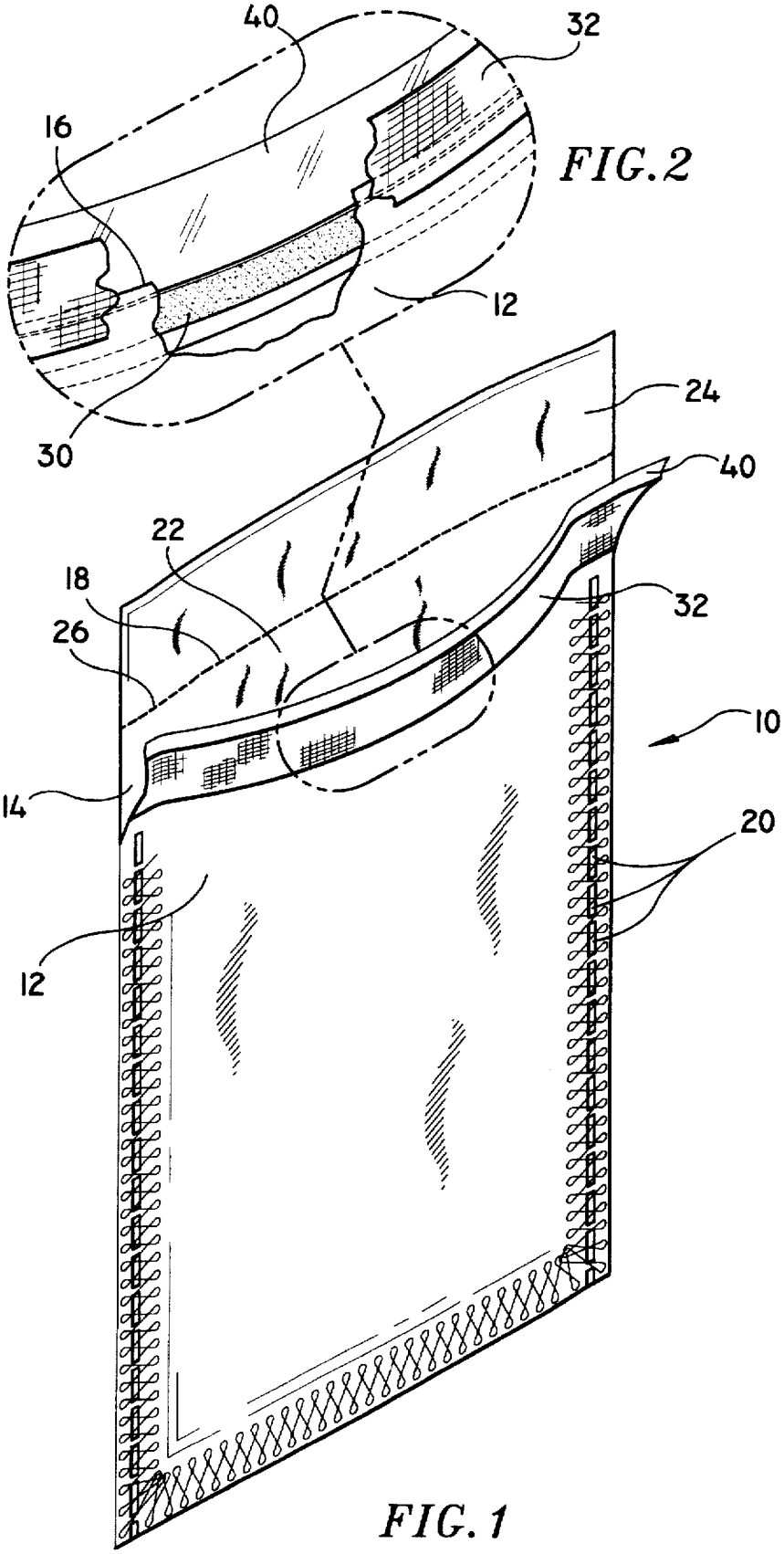
FIG. 1 is a perspective view of a tamper-resistant security envelope constructed in accordance with a preferred embodiment of the subject invention.
FIG. 2 is an enlarged localized perspective view of an upper area of the tamper-resistant envelope of FIG. 1 with a portion of the front panel removed to illustrate the adhesive seal.

Referring now in detail to the drawings wherein like reference numerals identify similar structural elements of the subject invention, there is illustrated in FIG. 1 a tamper-resistant security envelope constructed in accordance with a preferred embodiment of the subject invention and designated generally by reference numeral 10. Envelope 10 is constructed with several security features including two types of seals which function to inhibit unauthorized entry into the interior of the envelope, and several visual systems which provide evidence of tampering.

Preferably, envelope 10 is formed from a single piece of plastic material which is folded in such a manner during a forming process so as to define the front and rear panels of the envelope. Alternatively, the two panels of the envelope may be formed separately from one another and subsequently joined together by fusing the respective side and bottom edges thereof. The material from which envelope 10 is constructed is preferably a light-weight durable plastic such as polyethylene, polypropylene, polyethylene teraphthalate, polyvinylchloride, vinyl acetate, or other similar plastic material. A material thickness of about 0.0002 inches or heavier is typical for security envelopes. The envelope material may be a single layer or multiple layers, and may be opaque, translucent or transparent.

Referring now to FIG. 1, envelope 10 includes two panels, a front panel 12 and a rear panel 14. The upper edge 16 of front 12 and the upper edge 18 of rear panel 14 define an opening for gaining access into the interior of the envelope. The front and rear panels of the envelope are joined to one another along the respective side and bottom edges thereof by heat welding methods which are well known in the art. The fused or welded regions extend from the bottom edge of the envelope and terminate at a location slightly below the upper edge 16 of front panel 12 to further define the opening of the envelope.

One method by which plastic security envelopes have been infiltrated is by cutting open or slicing the fused side edges of the envelope to access or remove the contents thereof, and subsequently resealing the edges with heat sealing means so that the illicit access is difficult to detect. To make such intrusions more difficult and/or evident, a skip seal is provided adjacent each of the opposed side edges of the envelope. The skip seal, which consists of a plurality of linearly spaced apart heat fused areas 20 that extend parallel to the fused edges of the envelope, is very difficult to reseal by heating without presenting visual evidence of tampering.

Figure 4:
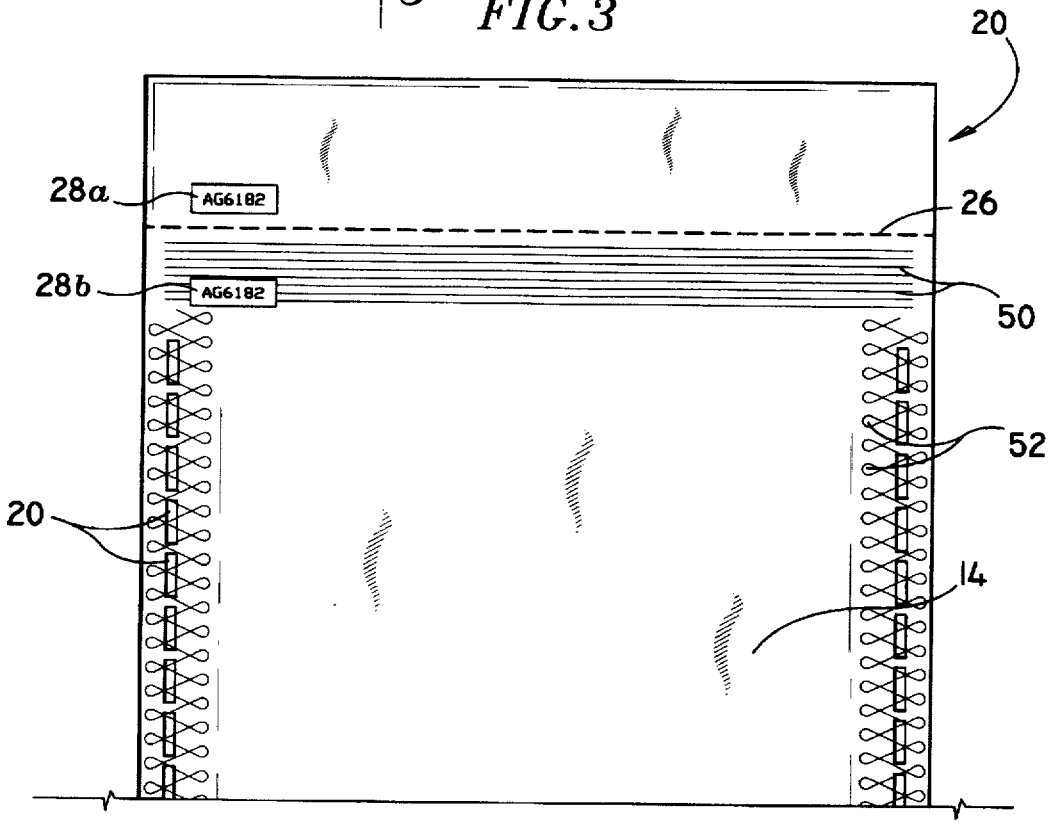
FIG. 4 is rear elevational view of the tamper-resistant envelope illustrated in FIG. 1 with the an envelope identification system shown in the form of numerical indicia provided on the envelope and a removable receipt portion thereof.
Figure 6:
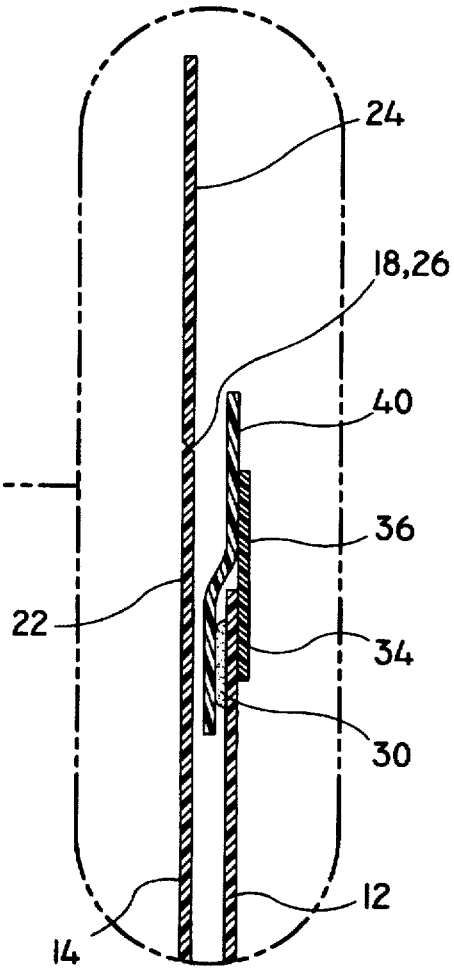
FIG. 6 is an enlarged localized view of the upper region of the tamper-resistant envelope illustrated in FIG. 1 with the release liner strip covering the first and second adhesive seals to prevent their contact with the interior surface of the rear panel prior to closing the envelope.

With continued reference to FIG. 1 in conjunction with FIG. 6, the upper edge 18 of rear panel 14 extends beyond the upper edge 16 of front panel 12 to define a panel extension 22. A flap section 24 is operatively connected to panel extension 22 by a perforation line 26 which delimits the upper edge 18 of rear panel 14. The flap section 24 defines a receipt which may be removed from the envelope by tearing along perforation line 26, and retained by the sender for tracking purposes. As shown in FIG. 4, corresponding numerical indicia **28*a* and 28*b* is imprinted on flap section 24 and on the exterior surface of rear panel 14**, respectively, to identify the envelope. It is envisioned that the indicia could alternatively be in the form of graphics, holographic images, or bar codes.

Referring to FIG. 2, security envelope 10 includes two adhesive seals for securely sealing the opening of the envelope. The first adhesive seal 30 consist of a layer of pressure sensitive adhesive sealant material which is applied to the interior surface of front panel 12 adjacent the upper edge 16 thereof, as shown in FIG. 2. Seal 30 defines a linear seal which extends across the entire width of the front panel a small distance above the point of termination of the fused side edges of the envelope. In a preferred embodiment of the subject invention, seal 30 is approximately ⅜" wide and the centerline of the seal is approximately ⅛" from the upper edge 16 of front panel 12.

Preferably, the sealant material from which seal 30 is formed has adherent properties which are resistant to, and unaffected by temperatures substantially below room temperature, or the application of freezing agents such as dry ice and freon spray. Such adhesive materials may be derived from acrylic, natural rubber, polyisobutylene, silicone, or other similar materials having the desired adherent properties. An extremely desirable adhesive material having such properties is available under the trade-name National 70-8615.

With continued reference to FIG. 2, the second adhesive seal 32 of envelope 10 is defined by a prefabricated strip of adhesive tape having a lower portion 34 mounted to the exterior surface of front panel 12 below the upper edge 16 thereof, and an upper portion 36 positioned to adhere to the interior surface of panel extension 22. Preferably, the upper portion 36 of tape seal 32 extends about ⅜" above and about ½" below the upper edge 16 of front panel 12. Adhesive tapes which are configured for such use are well known in the art, and are generally constructed with a backing material made of acetate mylar, polypropylene, polyethylene or vinyl, either treated or untreated with a concentration of adhesive thereon.

Figure 5:
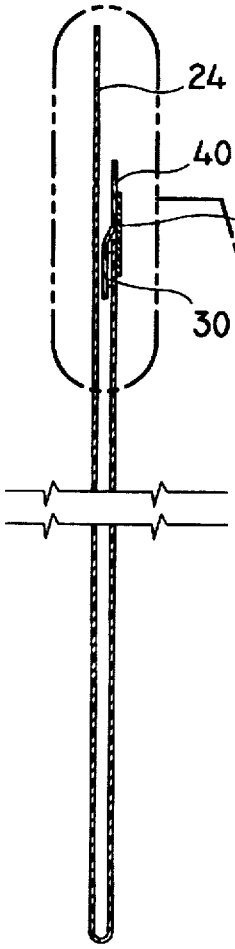
FIG. 5 is a cross-sectional view of the tamper-resistant envelope of the subject invention taken along line 5—5 of FIG. 3.

Referring to FIGS. 5 and 6, security envelope 10 also includes a protective release liner 40 which is formed of a strip of low adhesion plastic material suitable for use with the particular adhesive materials employed on the envelope. Release liner 40 is dimensioned and configured to cover the upper portion 36 of tape seal 32 and the entirety of adhesive seal 30 prior to closing the envelope. Release liner 40 prevents the two adhesive seals from contacting the interior surface of front panel 12 before the envelope is closed, i.e., during packing, storing, and handling. When the envelope is employed, release liner 40 is easily removable. Moreover, release liner 40 is preferably dimensioned to extend beyond the upper edge of tape seal 32, and beyond the lower limits of adhesive seal 30 to provide the user with a means for grasping the release liner during removal. Thus, the release liner has an approximate width of about 1½".

Figure 3:
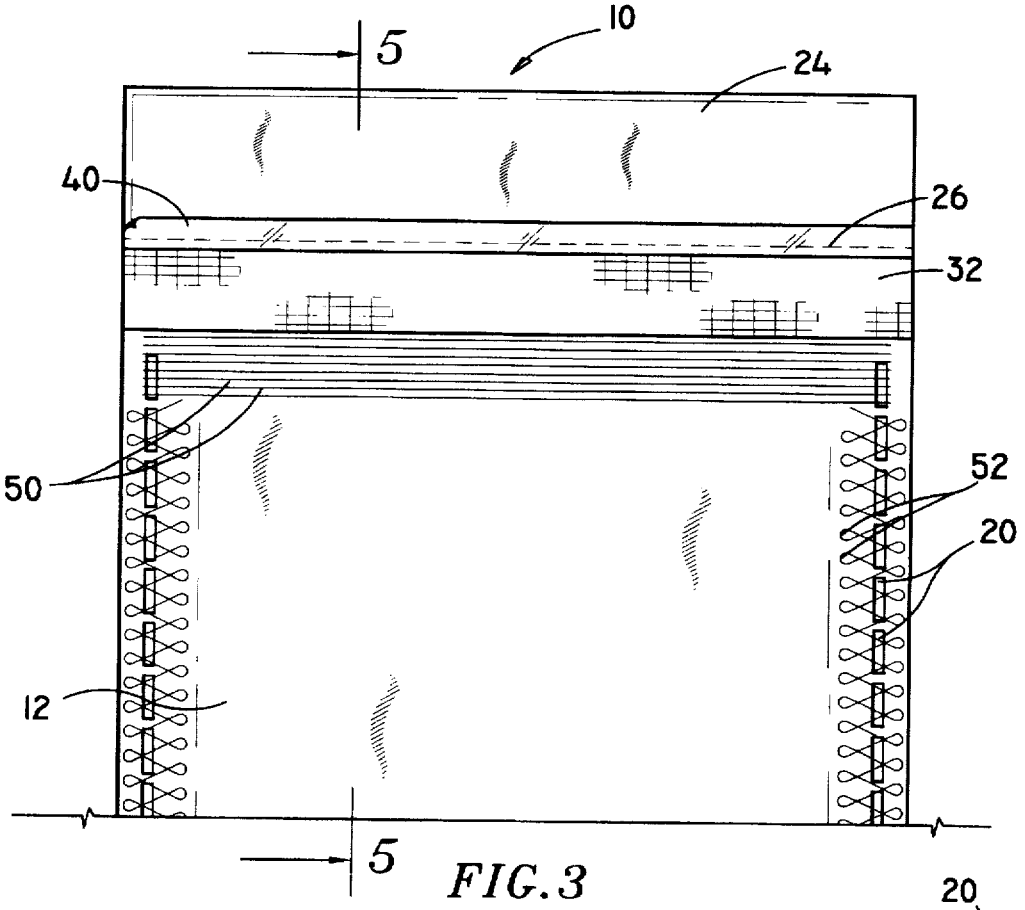
FIG. 3 is a front elevational view of the tamper-resistant envelope illustrated in FIG. 1 with the release liner strip positioned between the upper edges of the front and rear panels of the envelope.

Referring to FIGS. 3 and 4, security envelope 10 is also furnished with tamper-evident systems that provide visually observable evidence of tampering. In particular, the border regions of security envelope 10 are imprinted with geometric patterns that become distorted if attempts are made to open the envelope. The geometric patterns include a plurality of spaced apart parallel lines 50 which extend across the upper borders of both panels of envelope 10, and a swirled pattern 52 which is imprinted in the border regions adjacent the side and bottom edges of the front and rear panels of envelope 10. Any distortion of the geometric patterns will indicate to an observer that the envelope has been tampered with, and that its contents may have been compromised. For example, if attempts are made to lift tape seal 32, the parallel lines 50 imprinted along the upper border of the envelope will become distorted, providing evidence of tampering. Thus, the tape seal 32 need not be as strong as adhesive seal 30, but rather provide means for showing that tampering has occurred.

Figure 7:
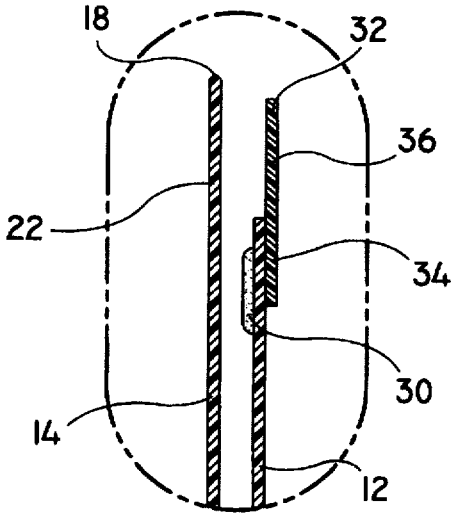
FIG. 7 is a localized view as in FIG. 6 with the release liner strip removed from the envelope to uncover the first and second adhesive seals.
Figure 8:
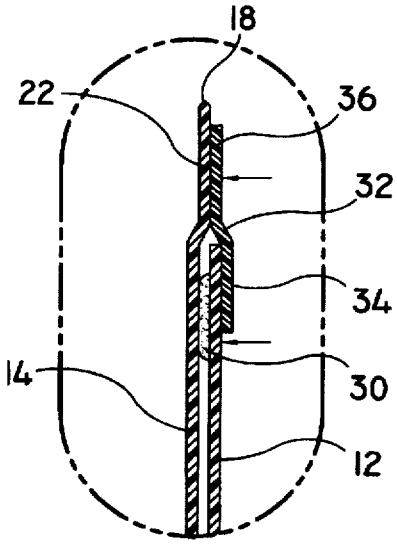
FIG. 8 is a localized view as in FIG. 7 illustrating the envelope in a sealed condition with the first and second adhesive seals secured to the interior surface of the rear panel of the envelope.
Figure 9:
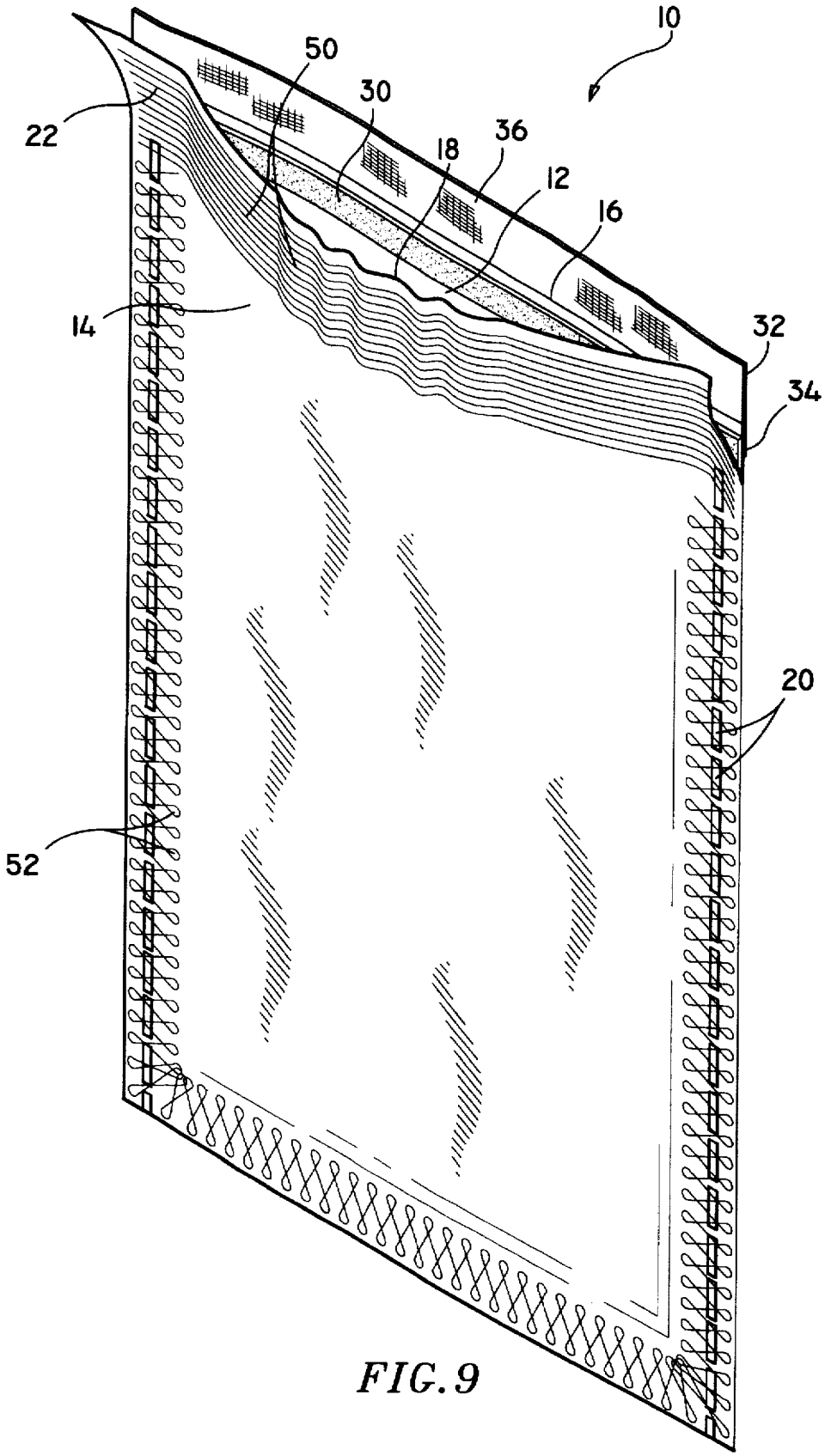
FIG. 9 is a perspective view of the tamper-resistant envelope of the subject invention viewed from the rear and illustrating the distortion in the geometric pattern imprinted on the seal region of the envelope which occurs as a result of tampering.

Referring now in sequential order to FIGS. 5–8, to securely seal envelope 10, release liner strip 40 is removed from the protective position illustrated in FIGS. 5 and 6, and discarded. At such a time, adhesive seal 30 and the upper portion 36 of adhesive strip 32 are free to contact the interior surface of panel extension 22 and rear panel 14, respectively, as shown in FIG. 7. Then, pressure is applied to the upper regions of the envelope to adhere seals 30 and 32 to rear panel 14, as shown in FIG. 8. Thereupon, envelope 10 cannot be opened by applying a cooling or freezing agent to the sealed region, since adhesive seal 30 is unaffected by such tampering. However, if such attempts are made, and force is applied to the sealed region of the envelope to gain access into the interior thereof, the parallel lines 50 imprinted adjacent the upper edge 18 of rear panel 14 will become distorted, as illustrated in FIG. 9, providing evidence of tampering.

Although the subject invention has been described with respect to preferred embodiments, it will be readily apparent to those having ordinary skill in the art to which it appertains that changes and modifications may be made thereto without departing from the spirit or scope of the subject invention as defined by the appended claims.

What is claimed is:

1. A tamper-resistant envelope comprising:

first and second panels each of monolithic construction joined to one another to define opposed side edges and a bottom edge of the envelope, each of said panels having an upper edge which together define an opening opposite the bottom edge of the envelope for providing access into the envelope, the upper edge of said second panel extending beyond the upper edge of said first panel to define a panel extension;

an adhesive sealant material being in direct contact with an interior surface of one of said first and second panels within the opening adjacent the upper edge thereof and extending parallel to the opening for sealingly adhering to an interior surface of the other of said first and second panels; and an adhesive sealing strip having a lower portion mounted to an exterior surface of said first panel and an upper portion positioned in such a manner so as to sealingly adhere to said panel, extension without folding of said panel extension.

2. An envelope as recited in claim 1, wherein said adhesive sealant material has adherent properties which are resistant to release at temperatures substantially below room temperature.

3. An envelope as recited in claim 1, wherein a release liner strip covers said adhesive sealant material and said upper portion of said adhesive sealing strip to prevent their contact with said second panel prior to closing the envelope.

4. An envelope as recited in claim 1, wherein a removable flap portion is connected to said second panel extension to define an envelope receipt.

5. An envelope as recited in claim 4, wherein a perforation line extends across the panel extension to delimit said removable flap and facilitate the removal thereof.

6. An envelope as recited in claim 1, wherein the envelope is formed from a single piece of material which is folded in such a manner so as to define said first panel and said second panel.

7. An envelope as recited in claim 1, wherein said first and second panels are formed separate from one another and are subsequently fused to one another along opposed side edges thereof to define opposed fuse lines which extend from the bottom edge of the envelope and terminate at a location below the upper edge of the first panel.

8. An envelope as recited in claim 7, wherein said layer of adhesive sealant material extends across the entire width of the interior surface of the first panel in an area proximate the location of the termination of the opposed fuse lines.

9. An envelope as recited in claim 8, wherein said first and second panels are further fused to one another at a plurality of linearly spaced apart locations adjacent the opposed fuse lines to define opposed skip seals.

10. An envelope as recited in claim 1, wherein geometric patterns are imprinted on exterior surfaces of the first and second panels about the peripheries thereof, said geometric patterns being adapted and configured to become distorted if envelope tampering occurs.

11. An envelope as recited in claim 1, wherein said adhesive sealant material has adherent properties which are resistant to release at freezing temperatures.

12. A tamper-resistant envelope comprising:

first and second panels each of monolithic construction joined to one another to define opposed side edges and a bottom edge of the envelope, each of said panels having an upper edge which together define an opening opposite the bottom edge of the envelope for providing access into the envelope, the upper edge of said second panel extending beyond the upper edge of said first panel to define a panel extension;

a layer of adhesive sealant material being in direct contact with and extending across an interior surface of said first panel adjacent the upper edge thereof within the opening for sealingly adhering to an interior surface of said second panel; and a prefabricated adhesive sealing strip having a lower portion mounted to an exterior surface of said first panel and an upper portion positioned in such a manner so as to sealingly adhere to an interior surface of said panel extension, without folding of said panel extension, said adhesive sealing strip extending over the upper edge of the first panel and covering the opening.

13. An envelope as recited in claim 12, wherein a release liner strip is coextensive with said layer of adhesive sealant material and said upper portion of said adhesive sealing strip to prevent their contact with said second panel prior to closing the envelope.

14. An envelope as recited in claim 12, wherein a removable flap portion is connected to said second panel extension to define an envelope receipt.

15. An envelope as recited in claim 14, wherein a perforation line extends across said panel extension to delimit said removable flap and facilitate the removal thereof.

16. An envelope as recited in claim 12, wherein the envelope is formed from a single piece of material which is folded in such a manner so as to define said first panel and said second panel.

17. An envelope as recited in claim 12, wherein said first and second panels are formed separate from one another and are subsequently fused to one another along opposed side edges thereof to define opposed fuse lines which extend from the bottom edge of the envelope and terminate at a location below the upper edge of the first panel.

18. An envelope as recited in claim 17, wherein said layer of adhesive sealant material extends across the entire width of the interior surface of the first panel in an area proximate the location of the termination of the opposed fuse lines.

19. An envelope as recited in claim 18, wherein said first and second panels are further fused to one another at a plurality of linearly spaced apart locations adjacent the opposed fuse lines to define opposed skip seals.

20. An envelope as recited in claim 12, wherein geometric patterns are imprinted on exterior surfaces of the first and second panels about the peripheries thereof, said geometric patterns being configured to distort if the if tampering occurs.

21. A tamper-resistant envelope comprising:

first and second panels fused to one another along respective sides thereof and joined to one another adjacent a bottom edge of the envelope, each of said panels having an upper edge which together define an opening opposite the bottom edge of the envelope for providing access into the envelope, the upper edge of said second panel extending beyond the upper edge of said first panel to define a panel extension;

a layer of adhesive sealant material extending across an interior surface of said first panel adjacent the upper edge thereof for sealingly adhering to an interior surface of said second panel, said adhesive sealant material having adherent properties which are resistant to release at temperatures substantially below room temperature;

a prefabricated adhesive sealing strip having a lower portion adhered to an exterior surface of said first panel below said upper edge thereof and an upper portion extending above said upper edge of said first panel so as to sealingly adhere to an interior surface of said panel extension; and a release liner strip dimensioned and configured to cover said layer of adhesive sealant material and said upper portion of said adhesive sealing strip to prevent their contact with said second panel prior to closing the envelope, said release liner strip extending beyond an upper edge of said adhesive sealing strip and being removable from said envelope to permit said adhesive sealant material and said upper portion of said adhesive sealing strip to sealingly adhere to said interior surface of said second panel.

* * * * *